US005351449A

United States Patent [19]

Allen et al.

[11] Patent Number: 5,351,449

[45] Date of Patent: Oct. 4, 1994

[54] STADIUM BUILDING

[75] Inventors: Christopher M. Allen, Nepean; Roderick G. Robbie, Toronto, both of Canada

[73] Assignee: 878953 Ontario Inc. and Rodarun Investments, Ltd., Ontario, Canada

[21] Appl. No.: 128,754

[22] Filed: Sep. 30, 1993

Related U.S. Application Data

[63] Continuation of Ser. No. 836,595, Feb. 18, 1992, abandoned.

[51] Int. Cl.[5] ..... E04H 3/10

[52] U.S. Cl. ..... 52/6; 52/66

[58] Field of Search ..... 52/66, 64, 82, 86, 6

[56] References Cited

U.S. PATENT DOCUMENTS

| | | | |
|---|---|---|---|
| 4,587,775 | 5/1980 | Lewis et al. | 52/66 X |
| 4,676,033 | 6/1987 | Allen et al. . | |
| 4,706,419 | 11/1987 | Adachi et al. | 52/65 |
| 4,738,057 | 4/1988 | Logan | 52/66 X |
| 4,831,792 | 5/1989 | Berger | 52/66 |
| 4,942,698 | 7/1990 | Kumagai | 52/66 X |

*Primary Examiner*—Carl D. Friedman
*Assistant Examiner*—Creighton Smith
*Attorney, Agent, or Firm*—Shlesinger, Arkwright & Garvey

[57] ABSTRACT

A repositionable roof, for a stadium building, comprising at least two opposed ungular segments in abutting relationship, the segments being mounted each on an arcuate track and movable thereon for separation of the segments to expose the interior of the building thereby selectively providing an open air stadium.

9 Claims, 8 Drawing Sheets

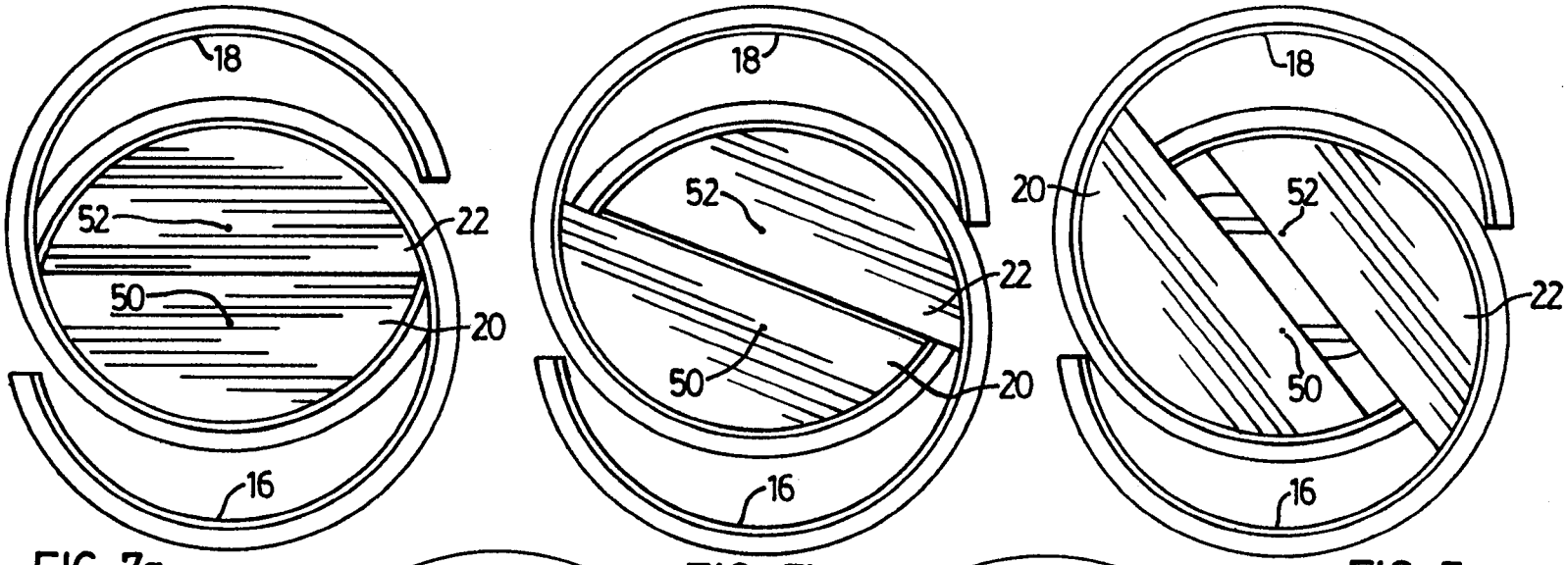
FIG. 7a
FIG. 7b
FIG. 7c
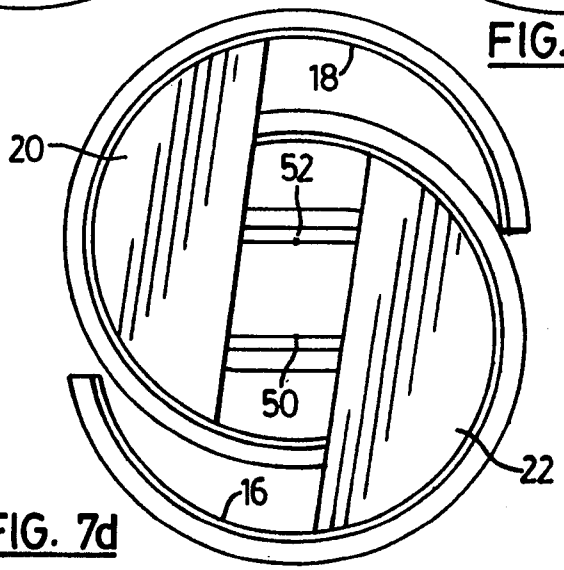
FIG. 7d
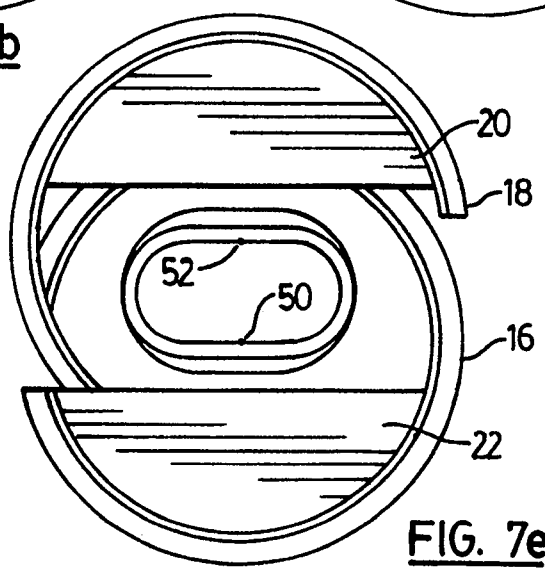
FIG. 7e

STADIUM BUILDING

This application is a continuation, of application Ser. No. 07/836595, filed Feb. 18, 1992 now abandoned.

FIELD OF THE INVENTION

This invention relates to a stadium building having a roof comprising at least two repositionable segments movable to provide an open air stadium.

BACKGROUND OF THE INVENTION

Covered stadiums have enjoyed a certain popularity for their controlled environments suitable for sporting and other events regardless of weather conditions. Unfortunately, during periods of fine weather the controlled environment of the covered stadium may detract from the enjoyment that one may derive from enjoying a spectacle in natural ambient conditions. In an effort to satisfy patrons, stadiums covered with retractable roofs have been devised which allow the interior of the stadium to be exposed during favourable weather conditions. One obvious problem with roofs of this type is that they are quite expensive to construct. Further, some dissatisfaction has been found in that some stadiums do not open sufficiently to achieve complete exposure of the interior of the stadium. In one known type of structure, a rectangular roof slides away as a complete unit, while in another type of structure a round roof is opened in the manner of a camera lens shutter. It is obvious that the sliding roof requires additional land for roof storage when open while the shutter roof leaves an overhanging arch.

To meet problems found in these past forms of movable roof structures, U.S. Pat. No. 4,676,033 to Allen and Robbie issued Jun. 30, 1987, comprises a roof having a central arch which separates a pair of ungular (i.e., hoof-like) end segments, one end segment being fixed, the other end segment being movable into nesting relationship with the fixed end segment, and the central arch being movable to nest above the fixed end segment, to expose the interior of the stadium. While the latter structure is an improvement over the previous removable roof covered stadiums, it is not a true dome stadium because the dome appearance is only approximated. By the term "true dome" is meant a continuously curved roof which does not require steps between adjacent segments to allow the roof to open or close.

Further, where the removable roof requires rectilinear movement of the roof structure by means of multiple bogies in two parallel lines, there are problems related to skewing of the roof. In the roof structure of Allen and Robbie it has been noted that the ungular roof segment which moves in a curved linear path creates no problems related to skew as do those portions of the roof which move rectilinearly.

To overcome these problems, it is an object of the present invention to provide a stadium having a repositionable roof of relatively simple construction giving maximum exposure of the interior of the stadium.

It is a further object of the present invention to provide a stadium having a repositionable roof which is a true dome.

Another object of the present invention is to provide a stadium having a repositionable roof, the opening and closing of which creates a visual spectacle for stadium-goers.

Another object of the present invention is to eliminate the complexity of skew in the movement of a roof segment.

SUMMARY OF THE INVENTION

Essentially the invention consists of a repositionable roof, for a stadium building, comprising at least two opposed ungular segments which abut each other in a closed position to form an enclosed roof, each of the segments being supported solely on its own circular track means in spaced relation to the centroid of its own circular track means, said circular track means being horizontal and positioned eccentrically with respect to each other, each of said segments being movable horizontally on its own circular track means for separation of the segments to expose the interior , of the building whereby, because each circular track means is horizontal, gravitational forces do not have to be overcome when said segments are moved.

In another aspect, the present invention comprises a repositionable roof system for a stadium comprising two eccentric horizontal circular track segments each one of said two track segments comprising the sole support for an ungular roof segment which is mounted for horizontal movement along said one track segment, the circular track segments positioned such that said ungular roof segments may be translated horizontal in a circular direction rotating 180 degrees from a first position in opposed abutting relationship wherein the segments form an enclosed roof to a second position in spaced relationship wherein each segment faces the opposite direction than in the first position, and wherein the segments face each other in the same manner as in the first position but at a considerable gap whereby the interior of the building is exposed.

BRIEF DESCRIPTION OF DRAWINGS

Example embodiment of the invention are shown in the accompanying drawings in which.

Figure 1:
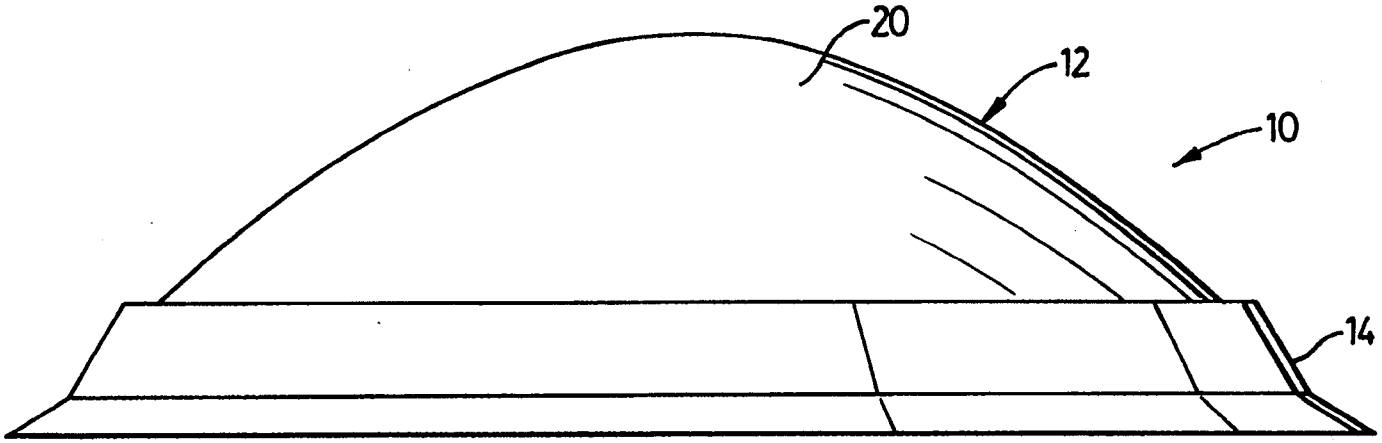
FIG. 1 is an end view of one embodiment of the stadium in elevation.
Figure 2:
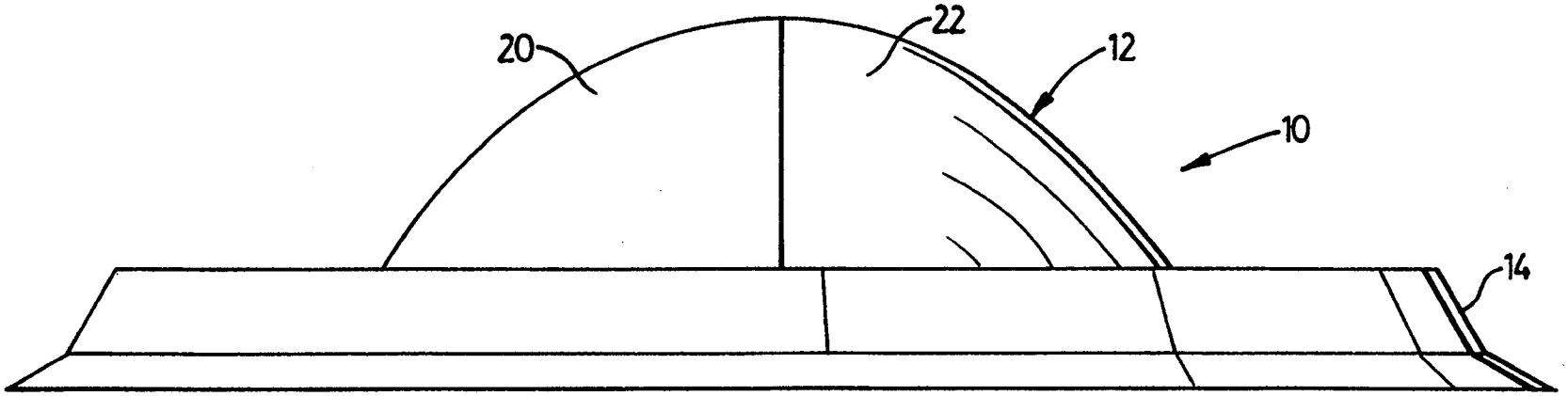
FIG. 2 is a side view of the stadium of FIG. 1 showing the roof in a closed position.
Figure 3:
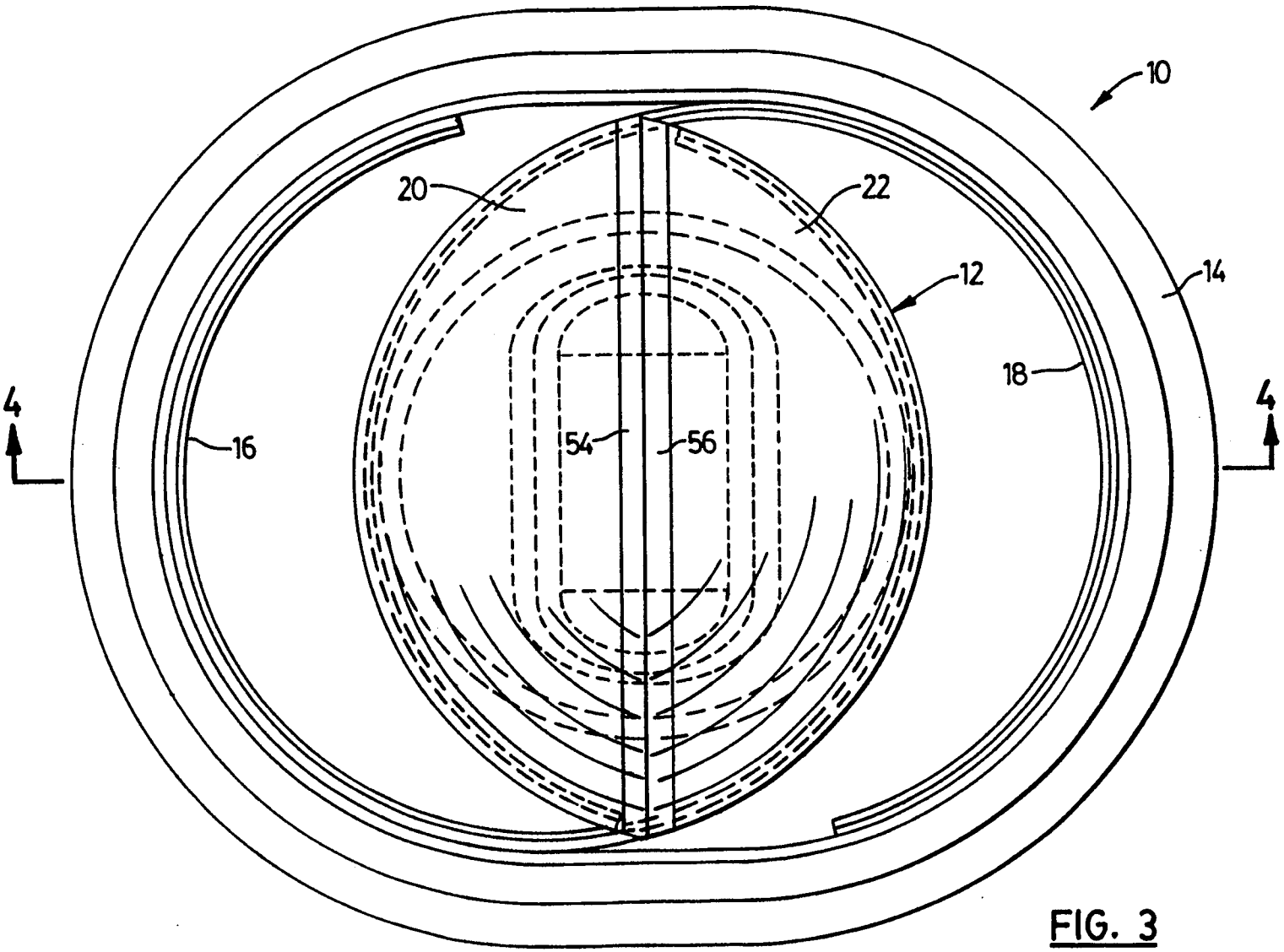
FIG. 3 is a plan view of the stadium of FIG. 2.
Figure 4:
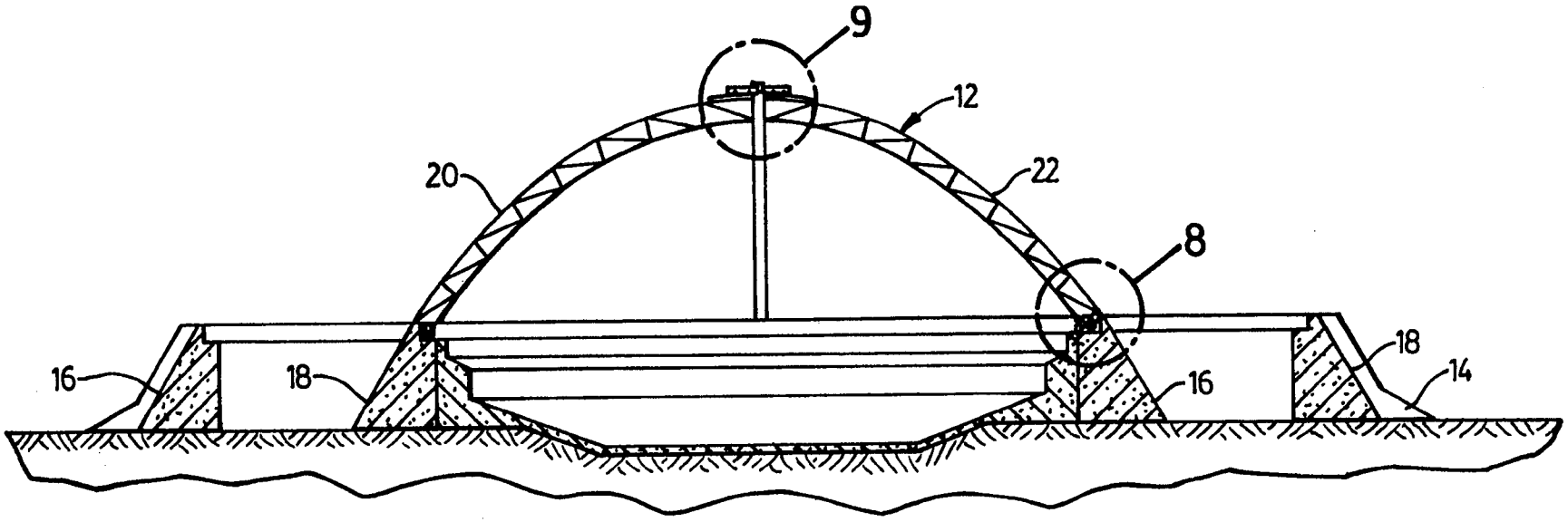
FIG. 4 is a cross-sectional view taken along line 4—4 of FIG. 3.
Figure 8:
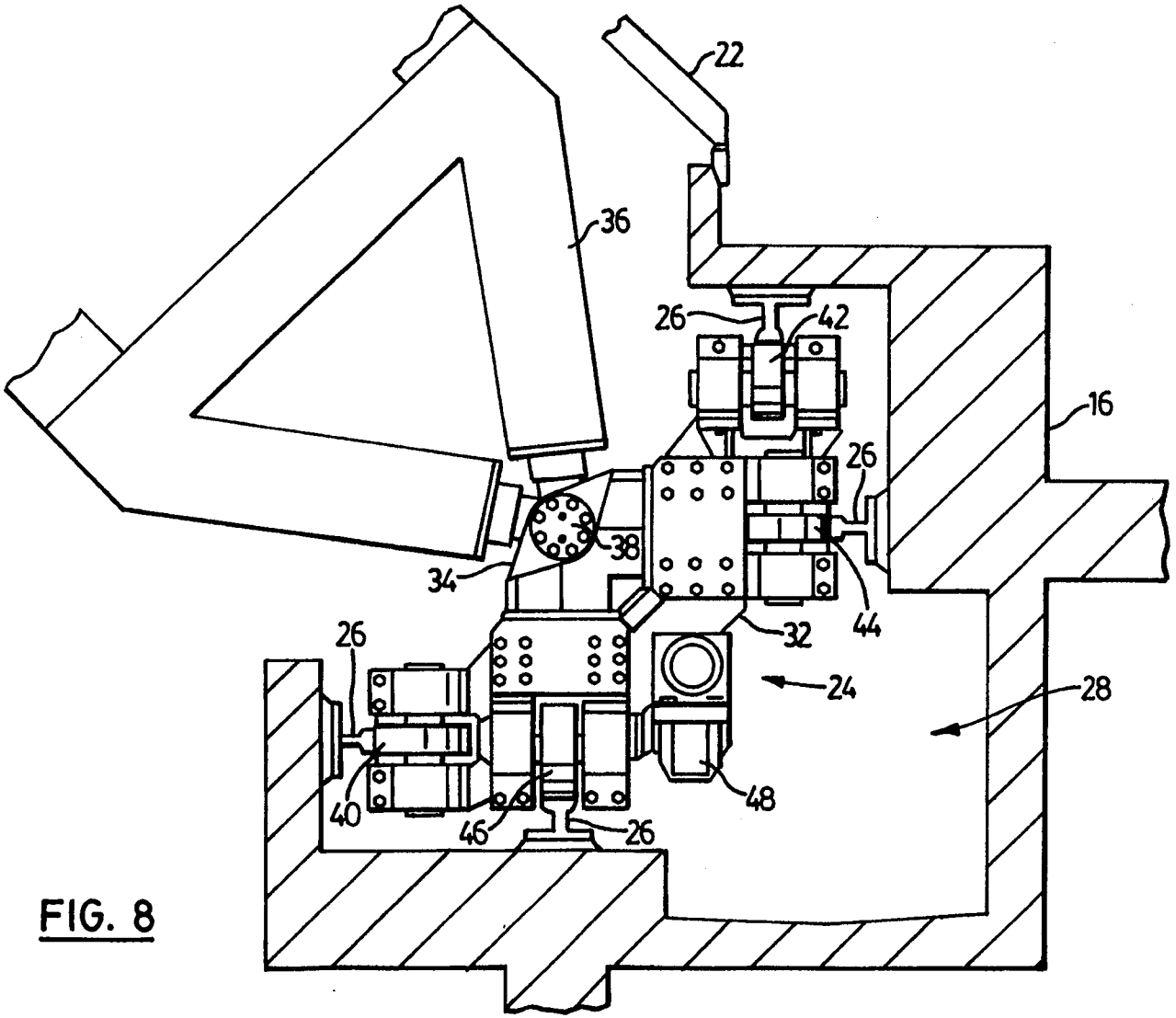
Figure 10B:
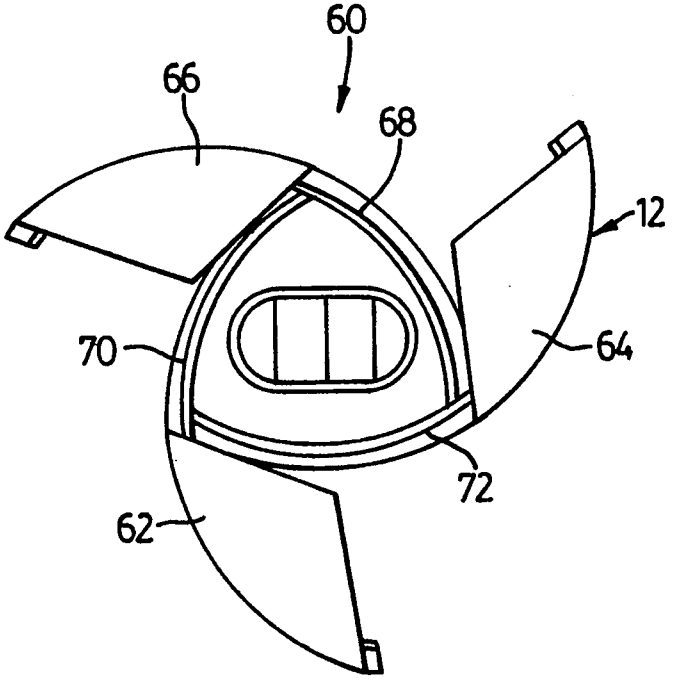
Figure 10A:
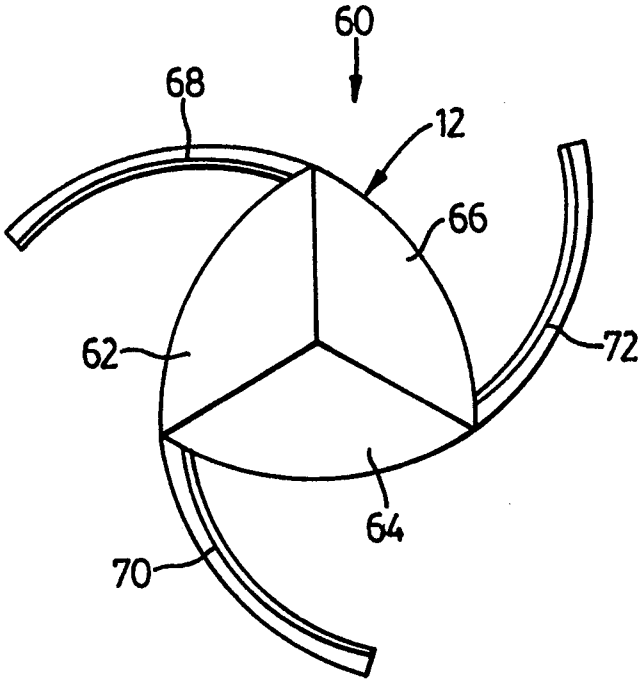

FIGS. *7a* through *7e* are a series of plan views stadium of FIG. 1 showing the interrelationship of the movable ungular roof segments during various stages of opening and closing the roof;

FIG. 8 is a detail view of area 8 in FIG. 4 showing the interrelationship of the side walls of the structure and the trucks or bogies of the movable ungular roof segments;

FIG. *9a* and *9b* are details of area 9 in FIG. 4 showing an example sealing arrangement between the movable ungular roof segments when in abutting relationship; and FIGS. 10*a* and 10*b* are plan views of a further example embodiment showing the positions of three movable ungular roof segments of the roof when closed and open respectively.

DESCRIPTION OF PREFERRED EMBODIMENT

The example embodiment shown in FIGS. 1 to 9 of the drawings consists of a stadium building 10 having a roof 12 covering an interior area within a circumscribing base structure 14. Located within base structure 14 are two eccentric circular sections 16 and 18 upon which roof 12 rests. As best seen in FIGS. *7a* to *7e*, the circular segments 16, 18 have the same diameter. Roof 12 consists of two opposed, ungular sections 20 and 22 movably mounted on circular wall sections 16 and 18 respectively. By "ungular" it is meant that the sections are hoof-like in shape. Thus, as with hoofs, a variety of shapes are possible.

Roof segments 20 and 22 are carried on trucks or bogies 24 which travel on sets of track means comprising rails 26 one set located in each of recesses 28 in circular wall sections 16 and 18 respectively. An end view of one truck 24, of the type generally shown in U.S. Pat. No. 4,676,033, is shown in detail in FIG. 8 of the drawings and consists of a carriage frame 32 having a set of fixed anchor plates 34 to which a truss 36 of roof segment 20 or 22 is joined by a pin connection 38. Two spaced and axially offset pairs of wheels 40 and 42 are journally mounted on carriage frame 32 and two further spaced pairs of axially spaced double flanged wheels 44 and 46 are journally mounted on carriage frame 32 such that the axis of rotation of wheel 40 is perpendicular to the axis of rotation of wheel 42 and the axis of rotation of wheel 46 is perpendicular to the, axis of rotation of wheel 44. A plurality of trucks 24 are connectable to form rows of trucks in tandem. At least one truck 24 carries a direct drive motor 48 adopted to drive wheel 46. It will be apparent from this arrangement that the track means will resist an upward load on the roof segments.

Figure 5:
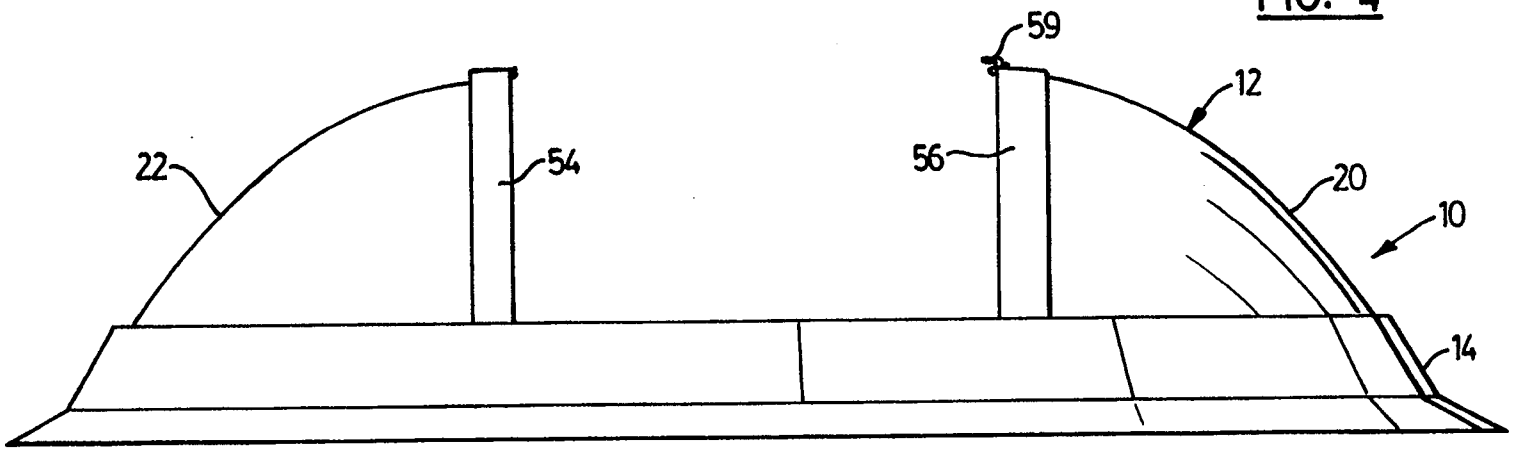
FIG. 5 is a side view of the stadium of FIG. 2 in open position.
Figure 6:
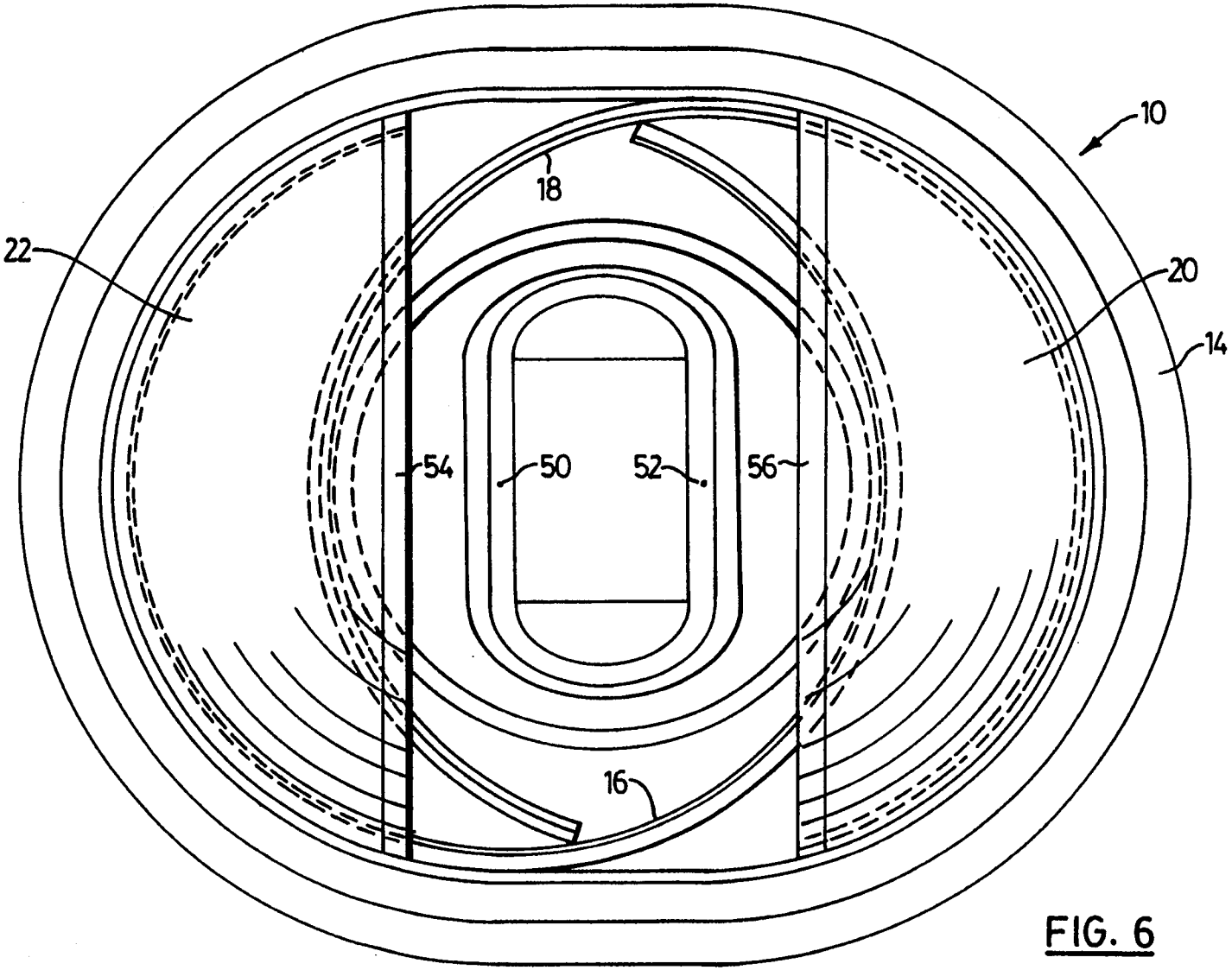
FIG. 6 is a plan view of the stadium of FIG. 2 in open position.

As seen in FIGS. 5, 6 and *7e*, roof 12, when open, has ungular roof segments 20 and 22 sitting opposed at the extreme ends of their respective tracks 26. In the preferred embodiment the movement of the two roof segments 20 and 22 mirror one another but it may be chosen to move the segments independently.

To open roof 12, ungular roof segments 20 and 22 are moved along circular wall sections 16 and 18 in a circular clockwise direction about imaginary centres (centroids) 50 and 52 of sections 16 and 18 respectively. As will be apparent from FIGS. *7a* to *7e*, roof segment 20 is supported on tracks carried by circular segment 18 in spaced relation to the centroid 52 of circular segment 18 and roof segment 22 is supported on tracks carried by circular segment 16 in spaced relation to the centroid 50 of the circular segment 16. Because the roof segments are spaced from the centroids of their supporting circular segments (and hence from the centroids of the tracks carried by their circular segments), they translate, as well as rotate, when they move along their supporting tracks.

Figure 9A:
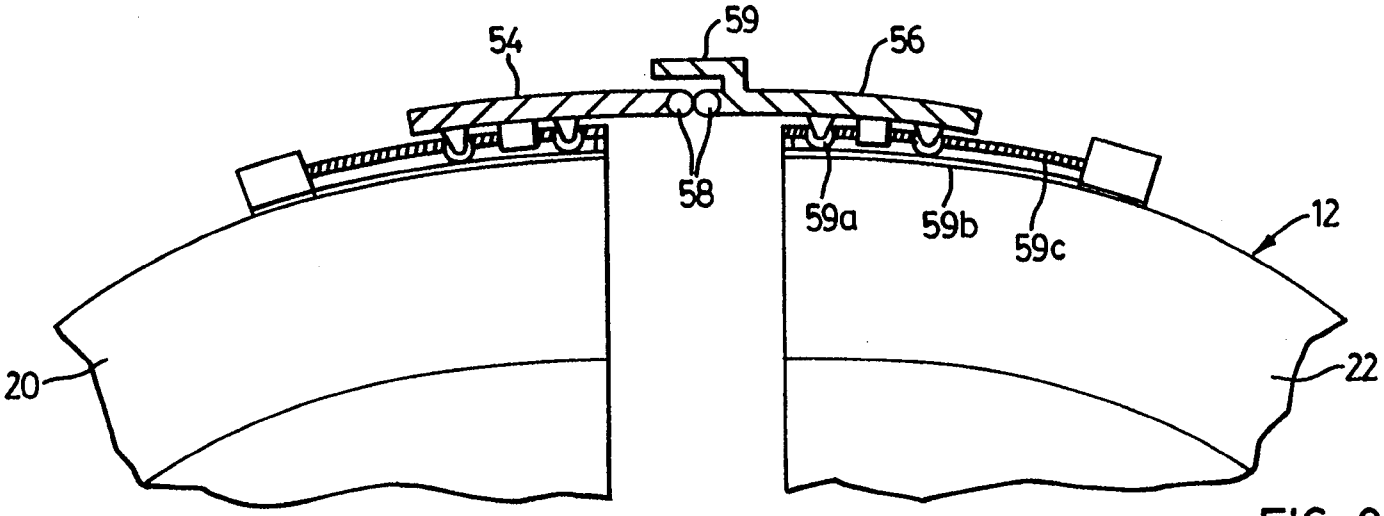
Figure 9B:
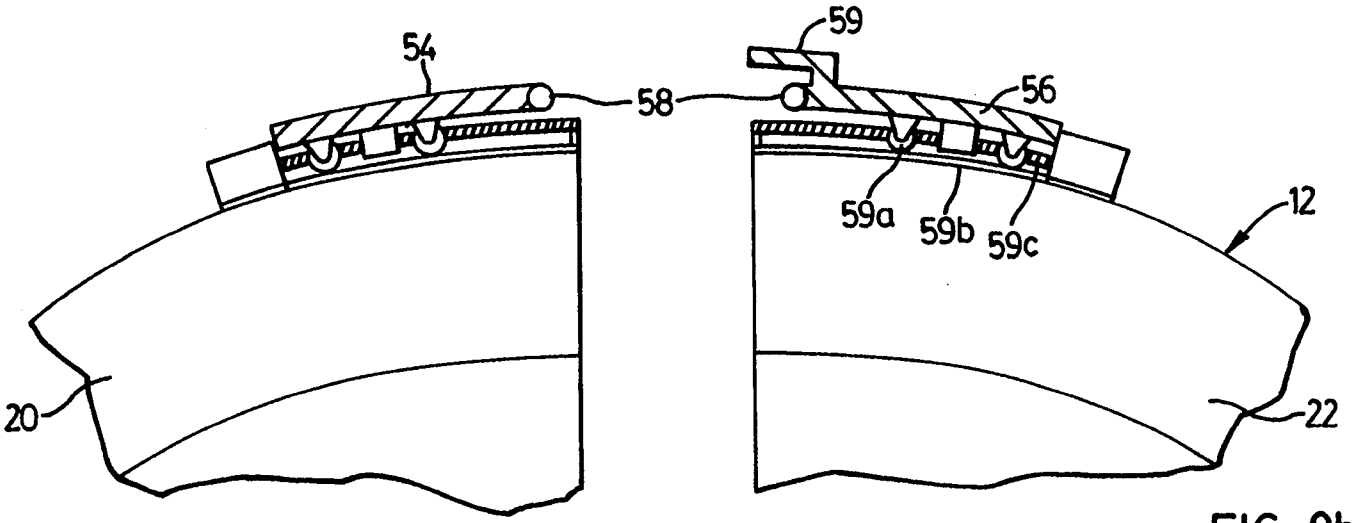

Roof sections 20 and 22 may carry interengaging means to seal the roof 12 in its closed position. As seen in FIG. 9, ungular roof segments 20 and 22 carry along their outer edges overhanging plates 54 and 56 respectively with tubular bumpers 58 which abut when plates 54 and 56 are extended into overhanging position as seen in FIG. *9a*, thus forming a vertical seal. An overlapping flange 59 protects abutting bumpers 58. Plates 54 and 56 are mounted on wheels *59a* running on tracks *59b* and driven by worm gears *59c*. Of course, plates 54 and 56 may be recessed in roof segments 20 and 22. Also, other means for sealing the roof in closed position may be employed.

In the alternate embodiment shown in FIG. 10, a roof 60 comprises three ungular segments 62, 64 and 66 movable on arcuate tracks 68, 70 and 72 respectively. The manner of moving segments 62, 64 and 66 is the same as in the previously described embodiment.

We claim:

1. In a stadium building, a repositionable roof comprising at least two opposed ungular segments which abut each other in a closed position to form an enclosed roof, each of the segments being supported solely on its own circular track means in spaced relation to the centroid of its own circular track means, said circular track means being horizontal and positioned eccentrically with respect to each other, each of said segments being movable horizontally on its own circular track means for separation of the segments to expose the interior of the building, whereby, because each circular track means is horizontal, gravitational forces do not have to be overcome when said segments are moved.

2. A stadium building as claimed in claim in which the track means is arranged to resist an uplift load on the roof segments.

3. A stadium building as claimed in claim 1 in which the movement of the segments is symmetrical about the centre of the stadium.

4. A stadium building as claimed in claim 1 having three opposed ungular segments in abutting relationship.

5. A stadium building as claimed in claim 1 wherein said two eccentric circular track means have the same diameter.

6. A stadium building as claimed in claim 1 in which said segments comprise the entire roof, such that the entire roof if repositionable.

7. A repositionable roof system for a stadium comprising two eccentric horizontal circular track segments each one of said two track segments comprising the sole support for an ungular roof segment which is mounted for horizontal movement along said one track segment, the circular track segments positioned such that said ungular roof segments may be translated horizontally in a circular direction rotating 180° degrees from a first position in opposed abutting relationship wherein the segments form an enclosed roof to a second position in spaced relationship wherein each segment faces the opposite direction than in the first position, and wherein the segments face each other in the same manner as in the first position but at a considerable gap whereby the interior of the building is exposed.

8. A stadium building as claimed in claim 7 wherein said two eccentric circular track segments have the same diameter.

9. A stadium building as claimed in claim 7 free of any fixed structure within any said gap.

* * * * *

UNITED STATES PATENT AND TRADEMARK OFFICE

CERTIFICATE OF CORRECTION

PATENT NO. : 5,351,449

DATED : October 4, 1994

INVENTOR(S) : Christopher M. Allen; Roderick G. Robbie

It is certified that error appears in the above-identified patent and that said Letters Patent is hereby corrected as shown below:

column 4, line 27, after "claim" insert --1--.

column 4, line 41, delete "if" insert --is--.

column 4, line 49, delete "180°" insert --180--.

Signed and Sealed this

Tenth Day of January, 1995

Bruce Lehman

*Attest:*

BRUCE LEHMAN

*Attesting Officer*

*Commissioner of Patents and Trademarks*